US007597722B2

(12) United States Patent
Eroshov et al.

(10) Patent No.: US 7,597,722 B2
(45) Date of Patent: Oct. 6, 2009

(54) PROCESS FOR MAKING POLYAMIDE TEXTILE ARTICLES BEARING DESIGNS IN DIFFERENT COLORS

(75) Inventors: Michael Eroshov, Kiryat Motzkin (IL); Alon Weiser, Netanya (IL); Thierry Mamodaly, Montpeller (FR); Ran Rotem, Ramat Ishay (IL); Boris Streltses, Migdal Ha'Emek (IL); Ariel Yedvab, Ramat Ishay (IL); Juliana Katz, Haifa (IL); Alexander Yermolaev, Migdal Ha'Emek (IL); Samuel Gazit, Givat Avni (IL)

(73) Assignee: Nilet Ltd., Migdal Ha'Emek (IL)

( * ) Notice: Subject to any disclaimer, the term of this patent is extended or adjusted under 35 U.S.C. 154(b) by 0 days.

(21) Appl. No.: 10/545,878

(22) PCT Filed: Feb. 19, 2004

(86) PCT No.: PCT/IL2004/000169

§ 371 (c)(1),
(2), (4) Date: Sep. 1, 2006

(87) PCT Pub. No.: WO2004/074564

PCT Pub. Date: Sep. 2, 2004

(65) Prior Publication Data

US 2007/0000065 A1 Jan. 4, 2007

(30) Foreign Application Priority Data

Feb. 20, 2003 (IL) ..... 154571

(51) Int. Cl.
*D06P 1/00* (2006.01)

(52) U.S. Cl. ..... 8/636; 8/531; 8/549; 428/97; 428/202; 428/375; 524/96; 524/360; 525/182; 525/426; 525/432; 528/313; 528/321

(58) Field of Classification Search ..... 8/531, 8/636, 21, 168, 549; 525/432, 426, 606, 525/182; 428/97, 202, 375; 57/245; 264/78; 528/321, 313; 524/360, 96; 442/181
See application file for complete search history.

(56) References Cited

U.S. PATENT DOCUMENTS 3,039,990 A * 6/1962 Huffman ..... 528/321

(Continued)

FOREIGN PATENT DOCUMENTS

EP 409093 1/1991

(Continued)

OTHER PUBLICATIONS

E. I. duPont de Nemours and Company, Consumer Feedback, Dyeing & Finishing Technology, Smooth Solutions: Seamless Knitting Market and Technology Update, Apr. 2001.*

(Continued)

*Primary Examiner*—Lorna M Douyon
*Assistant Examiner*—Khanh Tuan Nguyen
(74) *Attorney, Agent, or Firm*—Roach Brown McCarthy & Gruber, P.C.; Kevin D. McCarthy

(57) ABSTRACT

Process for manufacturing a fabric having distinctive and sharp differentially colored patterns or designs, which process comprises the steps of: (a) producing a first and a second polyamide, said polyamides having different concentrations of amine groups; (b) producing a first and a second polyamides having different concentrations of carboxyl end-groups and sulfonate groups; (c) producing a first yarn from said first polyamide and a second yarn from said second polyamide; (d) making a fabric having first surface areas defined by said first yarn and second surface areas defined by said second yarn; and (e) chemically dyeing said fabric in a dyeing bath comprising at least one anionic (acid) dyestuff and at least one cationic (basic) dyestuff, whereby said first yarn and therefore said first surface areas are dyed predominantly by said anionic dyestuff and said second yarn and therefore said second surface areas are dyed predominantly by said cationic dyestuff.

6 Claims, 3 Drawing Sheets

U.S. PATENT DOCUMENTS

| | | | | | |
|---|---|---|---|---|---|
| 3,142,662 | A | * | 7/1964 | Huffman | 528/313 |
| 3,184,436 | A | * | 5/1965 | Magat | 528/321 |
| 3,328,341 | A | * | 6/1967 | Corbin, Jr. et al. | 524/360 |
| 3,328,431 | A | | 6/1967 | Bowers et al. | |
| 3,389,549 | A | * | 6/1968 | David | 428/202 |
| 3,511,815 | A | * | 5/1970 | Ahmet | 524/96 |
| 3,542,473 | A | | 11/1970 | Herte | |
| 3,542,743 | A | | 11/1970 | Flamond | |
| 3,635,653 | A | * | 1/1972 | Snider et al. | 8/531 |
| 3,700,398 | A | * | 10/1972 | Cole, Jr. | 8/531 |
| 3,846,507 | A | * | 11/1974 | Thomm et al. | 525/432 |
| 3,865,900 | A | * | 2/1975 | DeCaprio et al. | 525/182 |
| 3,951,599 | A | | 4/1976 | Davis et al. | |
| 4,017,255 | A | * | 4/1977 | Cobb | 8/531 |
| 4,075,378 | A | * | 2/1978 | Anton et al. | 428/97 |
| 4,295,329 | A | * | 10/1981 | Windley | 57/245 |
| 5,131,918 | A | * | 7/1992 | Kelley | 8/549 |
| 5,242,733 | A | * | 9/1993 | Windley | 428/97 |
| 5,340,886 | A | * | 8/1994 | Hoyt et al. | 525/426 |
| 5,545,363 | A | | 8/1996 | Hoyt et al. | |
| 5,548,037 | A | | 8/1996 | Hoyt et al. | |
| 5,560,973 | A | | 10/1996 | Hoyt et al. | |
| 5,562,871 | A | | 10/1996 | Hoyt et al. | |
| 6,524,503 | B2 | * | 2/2003 | Gazit et al. | 264/78 |
| 2002/0124904 | A1 | | 9/2002 | Howland et al. | |
| 2003/0152770 | A1 | * | 8/2003 | Skidds | 428/375 |
| 2003/0220037 | A1 | * | 11/2003 | Dewhurst et al. | 442/181 |

FOREIGN PATENT DOCUMENTS

| | | | |
|---|---|---|---|
| GB | 1161411 | * | 10/1966 |
| GB | 1142297 | | 2/1969 |
| JP | 01-223908 | * | 9/1989 |

OTHER PUBLICATIONS

International Search report from the corresponding PCT application; (1 page), Date Unknown.

* cited by examiner

PROCESS FOR MAKING POLYAMIDE TEXTILE ARTICLES BEARING DESIGNS IN DIFFERENT COLORS

FIELD OF THE INVENTION

The present invention relates to a process for making polyamide fabrics and textile articles bearing patterns or designs in different and distinct colors by a process, which comprises a single dyeing step.

BACKGROUND OF THE INVENTION

This invention refers to chemical dyeing, in particular of polyamide yarns. Chemical dyeing is affected by using acid or anionic dyes that bond chemically to the amino end-groups (primary amines), or to other amine (secondary and tertiary), of the polyamide chains, or basic or cationic dyes, that bond chemically to the carboxyl end-groups, or to other active sites, like sulfonate-groups, of the polyamide chains. The mechanism of Nylon dyeing has been thoroughly investigated and described in "Challenges in the Art and Science of Dyeing" AATCC symposium (No. 32), 1983. The rate of diffusion, hydrogen and ionic bonding of the dyestuff to the polyamide and the dyeing mechanism have been reported. Even small changes in the amino end-groups content may affect the uptake of the acid dyestuff by the yarn in the dyeing bath, and thus affect the depth of the dyeing and the color intensity of the garment. The process of controlling the dyeing depth of Nylon by acid dyestuff via variation in the amino end-group concentration is well known in the art. U.S. Pat. No. 3,511,815 teaches that by obtaining high amine-end group (120-150 meq/kg), the Nylon 6,6 exhibits increased dyeability.

U.S. Pat. No. 4,017,255 describes a process for manufacturing of fiber materials containing at least two groups of differentially dyeable nylon filaments of two types. A first filament type, for cationic dyeing purposes is composed of nylon having content of about 90 to 110 meq per gram of carboxyl end groups and amino end groups content of about 20 to 30 meq per gram. A second filament type, for anionic purposes, which is composed of nylon having content of about 20 to 30 meq per gram of carboxyl end groups and amino end groups content of about 90 to 110 meq per gram. Wherein, the two types of textile filaments can be simultaneously dyed with an anionic and cationic dyestuff.

However, as mentioned in U.S. Pat. No. 3,951,599, U.S. Pat. No. 3,542,473, U.S. Pat. No. 4,017,255 has a drawback, since the carboxyl end-group sites have a limited dyeing strength, i.e. acidity, thus such end groups do not dye optimally by cationic dyeing procedures. The application of cationic dyes, which react with the carboxyl end-groups of the nylon molecules, results in dyed nylon having unacceptable color fastness properties. In other words, it is possible to improve the effective cationic dyeing of the filaments that are described in U.S. Pat. No. 4,017,255, by other formulations. It has also been noted that yarn spinning of PA 6,6 having the high amino end-group content is difficult using normal manufacturing facilities, and they are known for their poor spinning efficiency, i.e. increased occurrence of breaks and drips, most likely due to gel formation.

Nylon has been modified to improve its dyeability with cationic dyes by adding sulfonate compound to the PA 6,6 to provide sulfonate groups which can be activated to react with cationic dyestuff, as described in U.S. Pat. No. 3,142,662, U.S. Pat. No. 3,389,549, U.S. Pat. No. 3,542,743, etc.

U.S. Pat. No. 4,295,329 teaches the use of a first yarn which contains sulfonate sites for cationic dyeing, and of a second yarn which is of regular or deep acid-dyeing capability. This process is suitable for the preparation of heavy denier bulked yarns within the range of 1500-5000 total denier, mostly for carpet applications.

U.S. Pat. No. 3,389,549 teaches that for providing polyamides with cationic dyeing capability, the PA 6,6 should have a level of at least 60 sulfonate equivalents, while amino end groups contents is within 10-30 meq per kg. U.S. Pat. No. 3,542,743 teaches that the sulfonate groups of modified nylon molecules can be activated to react with cationic dyestuff under acidic conditions independently of carboxyl groups. It has been shown that the sulfonate groups can be effectively dyed by cationic dyeing techniques, and they have good light fastness properties. Also, sulfonate groups impart anionic dye-resistant properties to the nylon by forming a salt with amino end groups, thereby rendering these amine groups no longer available to react with anionic dyes. Such yarns, spun from the modified nylon, for example, with sodium salt of 5-sulfoisophthalic acid, dye particularly well by cationic dyestuff, while in the presence of anionic dyestuff, in the same bath.

US Pre-Grant Publication US 2003/0220037 describes an iridescent fabric comprising a cationic-dyeable nylon polymer yarn and an acid-dyeable yarn, which can be dyed in a single bath using an acid dye and a cationic dye. The dyeability of the cationic-dyeable yarn of the iridescent fabric is ensured by providing sulfonate group concentration of about 55 meq per gram polymer, amino-end group concentration of no greater than 40 meq per kg polymer. In this specific formulation there is an insignificant difference in the concentration between sulfonate end groups and amino end groups to affect the cationic dyeability of the sulfonate yean. In the same Publication The deeply dyeing property of the second yarn is provided only for anionic-dyeable nylon yarn using an enhanced level of amine end-groups of about 70 meq per kg polymer. The cationic-dyeable yarn does not have the deeply dyeing property, since there is a relatively low level of sulfonate groups, and significantly high amino-end groups content in the cationic-dyeable yarn prevents the sulfonate groups from being available for cationic dyeing. In summary, although the fabric that described in Publication US 2003/0220037 dyes in two colors simultaneously, the contrast of the colors is not as distinct and sharp as it could be.

U.S. Pat. No. 3,328,431 describes the use of butyrolactone for reducing the number of amino end-groups and British Patent 1,142,297 describes the use of (-caprolactone for the same purpose.

U.S. Pat. No. 4,017,255 teaches a process for the manufacturing of fiber materials containing at least two groups of differentially dyed Nylon filaments, each having a different carboxyl end-group content.

European patent application EP 409,093 teaches a method for reducing the number of amino end-groups by reacting polyamide fibers and combining them with normal polyamide fibers, thus resulting in a two-tone yarn. This process is mainly useful for stain blocking in the carpet industry.

Co-pending patent application 141240, the contents of which are entirely incorporated herein by reference, discloses a process for the manufacturing of a differentially dyeable yarn, comprising the steps of:

- producing two polyamides having a different concentration of amine end-groups:
- spinning yarns from said two polyamides; and
- producing a yarn by intermingling said spun yarns made from said two polyamides, in texturing, or draw twisting, or draw winding processes. Preferably, the two polyamides are made from the same monomer or co-monomers.

Polyamide yarns, particularly those made from polycapronamide (Nylon 6), polyhexamethylene adipamide (Nylon 6,6), or polyhexamethylene sebacamide (Nylon 6,10) can be used in the textile industry in both knitting and weaving with high efficiency to form high quality and fashionable garments. These polyamides, especially Nylon 6,6, are used in the production of knitted leg-wear and body-wear garment. In these products, dyeing efficiency and cost effective dyeing processes are important considerations.

It is a purpose of the present invention to provide a process for preparing fabrics—woven, knitted or non-woven—having patterns or designs in at least two different colors, which process comprises a single dyeing operation. By "fabrics having patterns or designs in two different colors" is meant herein fabrics which comprise surface areas of a first color and surface areas of a second color, regardless of the shape and positioned relationship of said areas, which may be geometrically simple, such as stripes, or complex, such as intercalated curved shapes or figures in the first color on a background of the second color, and regardless of the technique by which said surface areas are created. The fabrics of the invention are made of polyamide yarns, particularly yarns of poly (hexamethylenediamine-co-adipic acid, (Nylon 6,6), poly (hexamethylenediamine-co-azelaic acid) (Nylon 6,9), poly-(hexamethylenediamine-co-sebacic acid) (Nylon 6,10), or copolymers thereof. Preferably, the different colors are obtainable one from basic (cationic) dyes and one from acid (anionic) dyes.

According to the present art, such fabrics having patterns or designs in different colors are obtained by providing two sets of yarns adapted to be dyed by different dyes, separately dyeing or pre-dyeing said two sets of yarns, and weaving or knitting a fabric from said dyed yarns so as to achieve a desired color pattern and, if the yarns are partially pre-dyed, finishing the final garment with a dyeing process. This is a fairly complex procedure, that requires at least two different dyeing operations or the availability of yarns with different colors, and is therefore expensive, and it limits the economical number of colors and shades that the manufacturer can use in making a textile product.

It is a purpose of this invention to provide a process for the manufacture of a fabric having distinct and sharp differentially colored patterns or designs that is free of the drawbacks of the prior art, or cross staining of the yarns by the other dyes.

It is another purpose of this invention to provide a single-step dyeing process for manufacturing such a fabric that is simple and inexpensive.

Other purposes and advantages of the invention will become apparent as the description proceeds.

SUMMARY OF THE INVENTION

The invention provides a process of manufacturing a fabric having differentially colored patterns or designs, which process comprises the steps of:

1. producing a first polyamide having an increased amount of amino end-groups and other amino sites for enhanced anionic dyeing
2. producing a second polyamide modified by a sulfonate compound to enhance cationic dyeing
3. reduce the amino-end groups content in the second polyamide by a blocking agent to improve dyeability of the second polymer with cationic dyes, and simultaneously to reduce the anionic dyeing of the second polyamide by anionic dyestuff.
4. dyeing said fabric in a dyeing bath comprising at least one anionic (acid) dyestuff and at least one cationic (basic) dyestuff, whereby said first yarn and therefore said first surface areas are dyed predominantly by said anionic dyestuff and said second yarn and therefore said second surface areas are dyed predominantly by said cationic dyestuff. The term amino group relates to primary (end groups) secondary end tertiary amino groups as detected by conventional methods known to the person skilled in the art.

The method by which the fabric is made is not relevant to the invention. Thus, for instance, the invention applied equally to woven and to knitted fabrics.

The two polyamides may have and generally have different amounts of carboxyl end-groups as well as of amino end-groups, and this has an influence on the dyeability of the respective yarns, which is easily appreciated by persons skilled in the dyeing art. It should be understood that said first yarn is not insensitive to cationic dyes, but is poorly dyed by them, and this is what is meant by saying that it is predominantly dyed by anionic dyestuff; and, likewise, said second yarn is not insensitive to anionic dyes, but is poorly dyed by them, and this is what is meant by saying that it is predominantly dyed by cationic dyestuff. Yet, the polyamides are designed to minimize cross staining, and thus make it possible to achieve significant differentiation in sharp colors Preferably, but not exclusively, the two polyamides are modifications of a common polyamide.

According to preferred embodiments of the invention, the difference between the two polyamides in the amount of amino groups is from 45 to 145 meq/kg. According to another preferred embodiment of the invention, the amino group amount of the first polyamide is in the range of 70-150 meq/kg, and that of the second polyamide is in the range of 5-25 meq/kg. Another difference between the two polyamides is that the first polymer may have secondary and tertiary amines in the polymer chain, while the second polyamide has no such amine groups present in the chain. Also, preferably, the carboxyl end-group amount of the first polyamide is in the range of 30-45 meq/kg, and that of the second polyamide is in the range of 60-120 meq/kg. Furthermore, the second polyamide contains sulfonate groups ($SO_3H$) in the range of 50-150 meq/g, and preferably 70-100 meq/kg.

According to a preferred embodiment of the invention, the polyamides are selected among Nylon 6,6, Nylon 6,9 and Nylon 6,10.

Preferably, the dyeing bath comprises: at least one acid dyestuff chosen in the group consisting of the following commercial types: LANACRON brand dyestuff (by Ciba), ACIDOL brand dyestuff (by BASF), LANACYN brand dyestuff (by Clariant), and NEUTRILAN brand dyestuff (by Yorkshire); and at least one basic dyestuff chosen in the group consisting of the following commercial types: MAXITON brand dyestuff (by Ciba), YORACRYL brand dyestuff (by Yorkshire), and ASTRAZON brand dyestuff (by Bayer). Additional chemicals are placed in the dyeing bath as commonly practiced in the art, such as buffer solutions (2 gr/liter), sodium chloride (6 gr/liter), soda ash (1 gr/liter), leveling agents (2 gr/liter).

The preferred parameters and process steps of the dyeing operations are the following:

Mixing the dyeing chemicals at 40° C. for 10 minutes.

Raising the temperature to 98° C. at a rate of 1° C./min.

Holding for 30-45 minutes and then lowering the temperature to 70° C. at a rate of 1° C. per minute.

The rinsing the products with standard detergents and fixing the dye on the product by common fixing agents, as well known in the art The textile articles made from said fabrics having differentially colored patterns or designs and the process of making them are also aspects of the invention.

Another aspect of the invention is a process of making a textile article having differentially colored patterns or designs, which process comprises manufacturing at least one fabric as described hereinbefore and forming the textile article, by known textile techniques, so as to arrange said colored patterns or designs to obtain a predetermined ornamental effect. It will be understood that the different patterns or designs of the fabrics made according to the invention are so shaped and colored that such a predetermined ornamental effect can be obtained when the fabrics are processed into given textile articles.

DETAILED DESCRIPTION OF PREFERRED EMBODIMENTS

Figure 1:
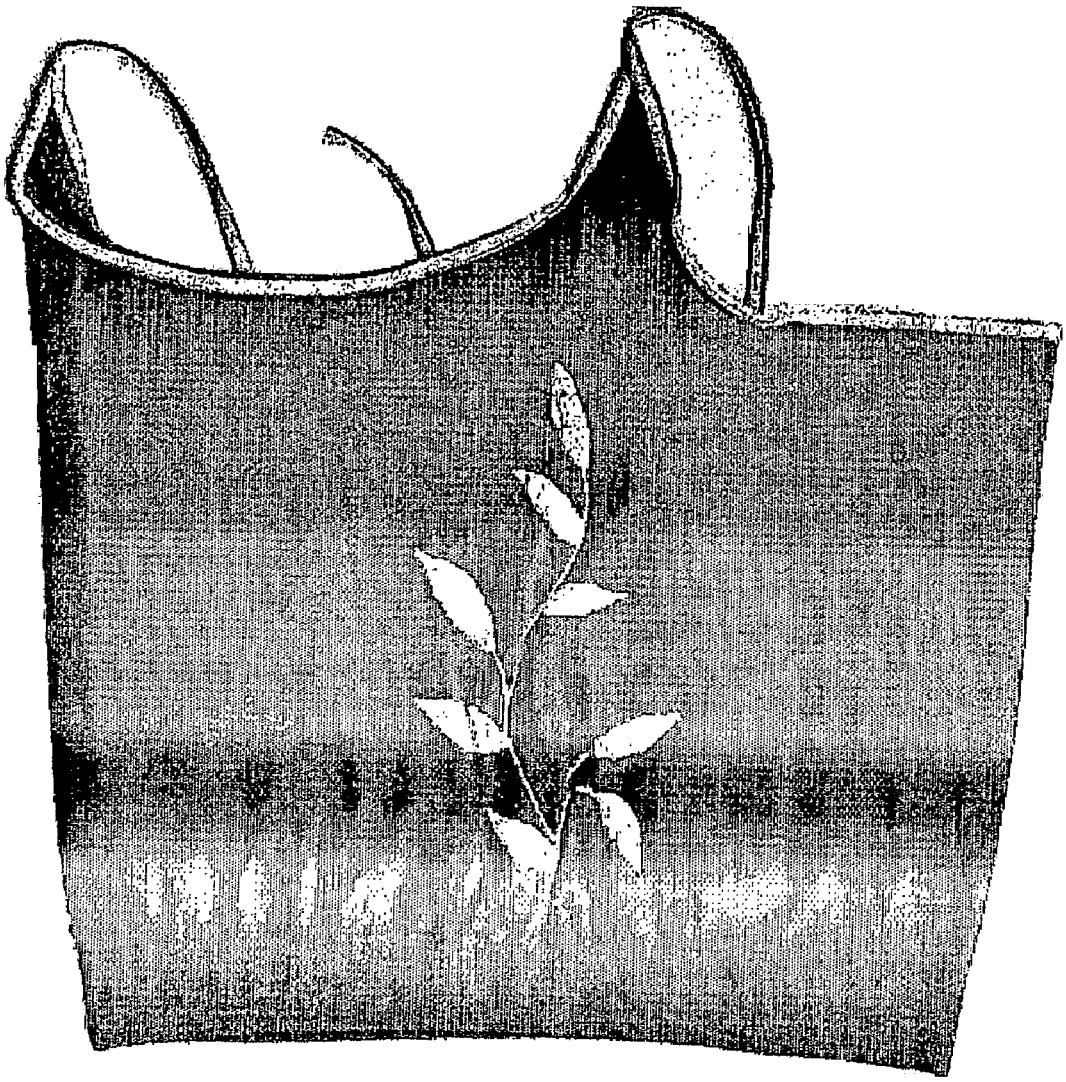
FIG. 1 shows a portion of a ladies top in which the body is knitted with one yarn (e.g. high amino) and has a purple color, and carries a pattern of leaves knitted with a second yarn (e.g. low amino) and has a light peach color.

As has been said, the present invention deals with fabrics made from polyamides, particularly Nylon 6,6(poly(hexamethylenediamine-co-adipic acid), Nylon 6,9(poly(hexamethylenediamine-co-azelaic acid), and Nylon 6,10(poly-(hexame-thylenediamine-co-sebacic acid) and thus, have the advantage of achieving the high quality properties with respect to tenacity, abrasion resistance, elongation, thermal properties and chemical resistance, that are typical of the Nylons.

Processes for modifying the number of amino end-groups, both for increasing and for decreasing the amino end-group content are known in the art.

In carrying out this invention, the preferred method for deepening the anionic dyeing of the polyamide, via increasing the amino groups, is achieved by making nylon yarn having high amino group contents in the range of 70-150 meq per kg polymer. It can be performed by adding diamine (hexamethylenediamine) monomer in excess, or modifiers for deep dyeing like N,N'-(bis-aminopropyl)piperazine, S-EED N,N'-Bis(2,2,6,6-tetramethyl-4-piperidinyl)1,3-benzenedicarboxamide (sold as Nylostab@ S-EED by CLARIANT) etc., or combination thereof into polymerization medium at polymerization stage.

Polyamides may be dyed with acid dyes by forming an ionic bond between the dyes and the protonated terminal amine groups present in the polyamide polymer chain. It is known that polyamide fibers having a lowered number of amino end groups have a reduced affinity for acid dyes. In carrying out this invention, the preferred method for achieving a polyamide with lower content of amino end-groups is by making nylon yarn from a polymer having sulfonate group contents in the range of 60-150 meq per kg polymer, preferably 70-100 meq/kg, followed by terminating a majority of amino end groups in the polymer by reacting them with a blocking agent, and thus freeing additional sulfonate groups for cationic dyeing.

A representative procedure for reducing the dyeability of polyamide fibers is disclosed in U.S. Pat. No. 3,328,341 to Corbin et al., and British Patent No. 1,142,297 to Burrows et al.

Corbin et al. describes the use of butyrolactone to reduce the acid dye affinity of nylons by the reduction of the number of amino end groups. Burrows et al. discloses the process for reducing affinity for acid dyestuffs by reacting polyamides with (-caprolactone. According to the process, the chemical blocking occurs by the addition of a compound which chemically interacts with the free amino end groups in the nylon polymer. For example, lactones, lactides, lactams, anhydrides, $\alpha,\beta$-unsaturated acids and their esters are useful in the present invention. Presently preferred are caprolactones and butyrolactones. The most preferred is (-caprolactone.

The above methods has been also employed to provide stain resistance for cationically dyeable sulfonate polyamide, as disclosed in U.S. Pat. No. 5,340,886, U.S. Pat. Nos. 5,545,363, 5,548,037, U.S. Pat. No. 5,560,973, U.S. Pat. No. 5,562,871, U.S. Pat. No. 5,340,886. Such polyamides can also be used in carpets prepared by mixing the cationically dyeable yarn with acid-dyeable yarn. The blocking agent used in the inventions to terminate amino end groups are considered as "stainblockers", i.e. the inventions deal with acid-dye resistance only, and are not aimed to the improvement in dyeability of cationic-dyeable nylon yarn.

It should be also noted that staining of cationic-dyeable yarn with acid dyes does not happen in the one-bath dyeing process of the present invention, since, in addition to stain-blocking action of sulfonate groups, the "high amino" acid-dyeable polymer of the two yarns consumes acid dye very rapidly and completely.

The precise manner that the blocking agent functions to reduce dyeability of the polyamide is not fully understood, and need not be. It is believed, however, that the blocking agent reacts with the amino end groups in the polyamide and thus reduces a portion of the acid dye sites normally present therein. The polyamide will then have hydroxyl end groups in place of the amine end groups. Regardless of the theory proposed, it is sufficient to point out that the agents operate successfully in the manner disclosed therein. The amount of base dye sites (carboxyl end groups) in the treated polyamide remains essentially the same as in the polymer untreated with the chemical blocking agent. If a polymer having a larger amount of carboxyl end groups is required, it can be made by using more than the stoichiometric amount of a diacide at the polymerization stage.

The amounts of chemical blocking agent added to the first fiber-forming polyamide will vary depending on the results desired and the polyamide used in the production of the fiber. Amounts less than 0.2% by weight based on the weight of the polyamide in general do not cause appreciable blocking of the amino end groups and the attendant lowering of dyeability in the polymer. While there is no upper limit with respect to the amount of chemical blocking agent which can be added, it has been found that amounts above about 3% by weight based on the weight of the polyamide do not further reduce the amino end group content by any appreciable extent. The polyamide fibers of the present invention preferably have a terminal amino-group content of less than 25 equivalents per $10^6$ grams polymer. For light color usage, the fibers preferably have terminal amino-group content in the range of from about 5 to 18 equivalents per $10^6$ grams polymer, more preferably from about 10 to 13 equivalents per $10^6$ grams.

Various methods of incorporating the chemical blocking agents into the polyamide can be utilized, and are known to persons skilled in the art.

a) adding the chemical blocking agent directly to the preformed polymer melt in the polymerization autoclave, so that the reaction of the blocking agent with the polyamide takes place immediately after the formation of the polyamide by polymerization of its monomeric constituents.

b) adding the chemical blocking agent to the chips of polyamide prior to melt formation and thoroughly tumbled therewith to effect adequate mixing and absorption of the agent into the polyamide, immediately after the chips have been tumble-dried to remove excess moisture and thus are still hot.

c) adding the chemical blocking agent to the polyamide chips at a feed zone of an extruder, using a feed pump.

If desired, the polyamides used in the invention can contain delustrants, antioxidants, light stabilizers, heat stabilizers, stainblockers, dye-resists, lubricants, mould release agents, nucleating agents, reinforcing or non-reinforcing fillers, pigments, dyes, antistatic agents plasticizers, antimicrobial agents, molecular weight regulators or other additives, these compounds being added during or after the polymerization reaction.

The following examples are illustrative and not limitative.

Example 1

First Combination of Polyamide Yarns

Preparation of the First Polyamide

An aqueous solution of hexamethylene diammonium adipate (AH salt) and an aqueous solution of hexamethylene diamine (HMD) in an amount of 0.5 mol % with respect to the AH salt, are charged into a stainless steel batch autoclave, under a nitrogen blanket. The autoclave is heated in order to distill the water, at a pressure of 18 Kg/cm$^2$. As the autoclave temperature reaches 244° C., the pressure is gradually released over a period of 40 minutes until reaching atmospheric pressure, then the polymer is maintained for additional 50 min at 274° C. under stirring at a slight vacuum. The polyamide is then discharged from the vessel under nitrogen pressure, and chilled by water. The solid polyamide strands are chopped into nylon 6,6 chips. The polyamide is characterized by a relative viscosity of RV=46-48, an amino end-group amount of 87-89 meq/Kg, a carboxyl end-group amount of 32-33 meq/Kg and the concentration of the titanium dioxide of 0.3% by weight Preparation of the Second Polyamide The second polyamide can be prepared at least by the two alternative ways set forth hereinafter as Variant 1 and Variant 2.

Variant 1

An aqueous solution of hexamethylene diamonium adipate (AH salt) is charged into a stainless steel batch autoclave, under a nitrogen blanket. The autoclave is heated in order to distill the water, at a pressure of 18 Kg/cm.sup.2. As the autoclave temperature reaches 244° C., the pressure is gradually released over a period of 40 minutes. Then the content of the autoclave is kept for 30 minutes at 274° C. under stirring. After that, caprolactone is added into the autoclave in an amount of 1.5% (by weight) of the polymer and the mixture is stirred for an additional 10 minutes. The polymer is then discharged from the vessel under nitrogen pressure, and chilled by water. The solid polymer streams ("spaghetti") are chopped into nylon 6,6 chips. The polymer is characterized by a relative viscosity of RV=42-44, amine end-group concentration of 10-13 meq/Kg, carboxyl end-group concentration of 74-78 meq/Kg and the concentration of the titanium dioxide is 0.3% by weight. After tumble-drying the polymer chips to remove excess moisture, they are melt-spun into fibers, which are characterized by amine end-group concentration of 10-15 meq/Kg, carboxyl end-group concentration of 74-78 meq/Kg.

Variant 2

An aqueous solution of hexamethylene diamoniumcebacate (CH salt) is charged into a stainless steel batch autoclave, under a nitrogen blanket. The autoclave is heated in order to distill the water, at a pressure of 18 Kg/cm.sup.2. As the autoclave temperature reaches 250° C., the pressure is gradually released over a period of 40 minutes. Then the content of the autoclave is kept for 30 minutes at 275° C. under stirring. The polymer is then discharged from the vessel under nitrogen pressure, and chilled by water. The solid polymer streams ("spaghetti") are chopped into nylon 6,6 chips. The polymer is characterized by a relative viscosity of RV=44-46, amine end-group concentration of 45-47 meq/Kg, carboxyl end-group concentration of 74-78 meq/Kg and the concentration of the titanium dioxide is 0.3% by weight. Then the polyamide chips are subjected to drying in a tumble-dryer to remove excess moisture. Immediately after the chips have been tumble-dried and are, therefore, still hot, e.g., have a temperature of 80-100° C., caprolactone is added into the dryer in an amount of 1.0% (by weight) of the polymer. The chips and the blocking agent are thoroughly tumbled for 6 hours to produce a uniform mixture of chips saturated with the blocking agent prior to melt formation. The polyamide chips are melt-spun into fibers, which are characterized by amine end-group concentration of 10-15 meq/Kg, carboxyl end-group concentration of 74-78 meq/Kg.

Spinning:

The chips of the two polyamides are separately spun in a POY process under the following conditions:

Each polyamide is spun separately.

TABLE I

| Conditions | First Polyamide | Second Polyamide |
|---|---|---|
| Relative viscosity (RV) | 43-45 | 48-50 |
| Polyamide temp. (° C.) | 295-305 | 295-305 |
| Pack pressure (atm) | 200-300 | 200-300 |
| Spin finish concentration (%) | 1% | 1% |
| Winding speed (m/min) | 4500 | 4500 |

The resulting yarns have the following characteristics:

TABLE II

Typical properties of yarn with high amino (first polyamide)

| Property | Value |
|---|---|
| Dtex | 93.6 |
| Tenacity (cN/dtex) | 3.6 |
| Elongation (%) | 24.6 |
| C.C. (%) | 46.2 |
| C.M. (%) | 23.0 |
| C.S. (%) | 90.6 |
| Interlace points | 80 |

TABLE II-continued

| Typical properties of yarn with high amino (first polyamide) | |
|---|---|
| Property | Value |
| % SF | 2% |
| Shrinkage (BWS %) | — |

TABLE III

| Typical properties of yarn with low amino (second polyamide) | |
|---|---|
| DTEX | 93.2 |
| Tenacity (CN/DTEX) | 3.8 |
| Elongation (%) | 24.4 |
| Modulus (CN/DTEX) (%) | 17.3 |
| Interlace (points/m) | *82 |
| Hardness | 63 |
| C.C. (%) | 44.9 |
| C.M. (%) | 21.5 |
| C.S. (%) | 91.2 |

Example 2

Second Combination of Polyamide Yarns

Preparation of the First Polyamide

A salt is formed by mixing water, sebacic acid and hexamethylene diamine (HMD) at a ratio of 1.5:1.03:1.0 respectively, at 55° C. At this temperature, the formed solution is 44% by weight. Hexamethylene diamine sebacate is formed. The solution pH is then adjusted to 7.5-8.0 by adding HMD. Additional HMD in an amount of 0.4 wt % with respect to the Hexamethylene diamine sebacate is added. Distillation and polymerization processes are then carried out in an autoclave for 100 minutes. At 250° C., the pressure is gradually dropped, while the polymerization proceeds, until atmospheric pressure is reached in the reactor, then the polymer is maintained at 274° C. for additional 50 min under stirring at a slight vacuum. The polyamide 6,10 is then discharged from the autoclave under nitrogen pressure, and chilled by water. The discharged solid polyamide strands are chopped to chips. The polyamide is characterized by a relative viscosity of RV=46-48, an amino end-group amount of 87-89 meq/Kg, a carboxyl end-group amount of 32-33 meq/Kg and the concentration of the titanium dioxide of 0.3% by weight Preparation of the Second Polyamide The second polyamide can be prepared at least by the two alternative ways set forth hereinafter as Variant 1 and Variant 2.

Variant 1

An aqueous solution of hexamethylene diamoniumcebacate (CH salt) is charged into a stainless steel batch autoclave, under a nitrogen blanket. The autoclave is heated in order to distill the water, at a pressure of 18 Kg/cm.sup.2. As the autoclave temperature reaches 250° C., the pressure is gradually released over a period of 40 minutes. Then the content of the autoclave is kept for 30 minutes at 275° C. under stirring. The polymer is then discharged from the vessel under nitrogen pressure, and chilled by water. The solid polymer streams ("spaghetti") are chopped into nylon 6,6 chips. The polymer is characterized by a relative viscosity of RV=44-46, amine end-group concentration of 45-47 meq/Kg, carboxyl end-group concentration of 74-78 meq/Kg and the concentration of the titanium dioxide is 0.3% by weight. Then the polyamide chips are subjected to drying in a tumble-dryer to remove excess moisture. Caprolactone in an amount of 1.6% by weight of the polymer is added along with chips of the polyamide at the feed zone of extruder prior to fiber formation via a feeding pump. The polyamide and caprolactone are then melted together to melt-spun into fibers, which is characterized by amine end-group concentration of 10-13 meq/Kg, carboxyl end-group concentration of 74-78 meq/Kg.

Variant 2

An aqueous solution of hexamethylene diamonium adipate (AH salt) is charged into a stainless steel batch autoclave, under a nitrogen blanket. Then adipic acid is added in an amount of 0.44% (by weight) of the amount of polyamide in order to increase concentration of carboxyl end-groups. The autoclave is heated in order to distill the water, at a pressure of 18 Kg/cm.sup.2. As the autoclave temperature reaches 244° C., the pressure is gradually released over a period of 40 minutes. Then the content of the autoclave is kept for 40 minutes at 274° C. under stirring. The polymer is then discharged from the vessel under nitrogen pressure, and chilled by water. The solid polymer streams ("spaghetti") are chopped into nylon 6,6 chips. The polymer is characterized by a relative viscosity of RV=42-44, amine end-group concentration of 25 meq/Kg, carboxyl end-group concentration of 105-107 meq/Kg and the concentration of the titanium dioxide is 0.3% by weight. Then the polyamide chips are subjected to drying in the tumble-dryer to remove excess moisture. Immediately after the chips have been tumble-dried and are, therefore, still hot, e.g., having a temperature of 80-100° C., caprolactone is added into the dryer in an amount of 1.0% (by weight) of the polymer. The chips and the blocking agent are thoroughly tumbled for 6 hours to produce a uniform mixture of chips saturated with the blocking agent prior to melt formation. The polyamide chips are melt-spun into fibers, which are characterized by amine end-group concentration of 8-12 meq/Kg, carboxyl end-group concentration of 103-106 meq/Kg.

Example 3

Third Combination of Polyamide Yarns

Preparation of the First Polyamide

The first polyamide can be prepared at least by the three alternative ways set forth hereinafter as Variant 1, Variant 2, and Variant 3.

Variant 1

An aqueous solution of 2377 g of hexamethylene diammonium adipate (AH salt), a 20% slurry of 18420 g N,N'-Bis(2,2,6,6-tetramethyl-4-piperidinyl) 1,3-benzenedicarboxamide (sold as Nylostab@ S-EED by CLARIANT) in aqueous AH salt solution, an aqueous 30% solution of 6400 g HMD, are charged into a stainless steel batch autoclave, under a nitrogen blanket. The autoclave is heated in order to distill the water, at a pressure of 18 Kg/cm$^2$. As the autoclave temperature reaches 244° C., the pressure is gradually released over a period of 40 minutes until reaching atmospheric pressure, then the polymer is maintained at 274° C. for additional 30 min under stirring at atmospheric pressure. The polyamide is then discharged from the vessel under nitrogen pressure, and chilled by water. The solid polyamide strands are chopped into nylon 6,6 chips. The polyamide is characterized by a relative viscosity of RV=40-42, an amino group amount of 95-105 meq/Kg, a carboxyl end-group amount of 45 meq/Kg and the concentration of the titanium dioxide of 0.3% by weight.

Variant 2

An aqueous solution of 2377 kg hexamethylene diammonium adipate (AH salt), a 20% slurry of 18420 g N,N'-Bis(2,2,6,6-tetramethyl-4-piperidinyl)1,3-benzenedicarboxamide (sold as Nylostab@ S-EED by CLARIANT) in aqueous AH salt solution, an aqueous 50% solution of salt of 36500 g N,N'-bis-(3-propylamine)piperazine and 26600 g adipic acid, are charged into a stainless steel batch autoclave, under a nitrogen blanket. The autoclave is heated in order to distill the water, at a pressure of 18 Kg/cm$^2$. As the autoclave temperature reaches 244° C., the pressure is gradually released over a period of 40 minutes until reaching atmospheric pressure, then the polymer is maintained at 274° C. for additional 30 min under stirring at atmospheric pressure. The polyamide is then discharged from the vessel under nitrogen pressure, and chilled by water. The solid polyamide strands are chopped into nylon 6,6 chips. The polyamide is characterized by a relative viscosity of RV=39-41, an amino group amount of 136-140 meq/Kg, a carboxyl end-group amount of 86-88 meq/Kg and the concentration of the titanium dioxide of 0.3% by weight Variant 3

2377 kg of an aqueous solution of hexamethylene diammonium adipate (AH salt), an aqueous 50% solution of salt of 18250 g N,N'-bis-(3-propylamine)piperazine and 13300 g adipic acid, 4800 g of benzylamine are charged into a stainless steel batch autoclave, under a nitrogen blanket. The autoclave is heated in order to distill the water, at a pressure of 18 Kg/cm$^2$. As the autoclave temperature reaches 244° C., the pressure is gradually released over a period of 40 minutes until reaching atmospheric pressure, then the polymer is maintained at 274° C. for additional 30 min under stirring at atmospheric pressure. The polyamide is then discharged from the vessel under nitrogen pressure, and chilled by water. The solid polyamide strands are chopped into nylon 6,6 chips. The polyamide is characterized by a relative viscosity of RV=36-38, an amino group amount of 94-96 meq/Kg, a carboxyl end-group amount of 72-74 meq/Kg and the concentration of the titanium dioxide of 0.3% by weight Preparation of the Second Polyamide The second polyamide can be prepared at least by the two alternative ways set forth hereinafter as Variant 1 and Variant 2.

Variant 1

An aqueous solution of 2377 g hexamethylene diammonium adipate (AH salt), and aqueous 50% solution of salt of 41.2 kg of 5-sulfoisophthalic acid and equimolar amount of HMD is charged into a stainless steel batch autoclave, under a nitrogen blanket. The autoclave is heated in order to distill the water, at a pressure of 18 Kg/cm.sup.2. As the autoclave temperature reaches 244° C., the pressure is gradually released over a period of 40 minutes to atmospheric pressure. Then the contents of the autoclave are kept for 40 minutes at 274° C. under stirring. The polymer is then discharged from the vessel under nitrogen pressure, and chilled by water. The solid polymer streams ("spaghetti") are chopped into nylon 6,6 chips. The polymer is characterized by a relative viscosity of RV=40-42, amine end-group concentration of 48-52 meq/Kg, carboxyl end-group concentration of 75-85 meq/Kg, sulfonate group concentration of 74-76 meq/Kg and the concentration of the titanium dioxide of 0.3% by weight. Then the polyamide chips are subjected to drying in the tumble-dryer to remove excess moisture. Immediately after the chips have been tumble-dried and are, therefore, still hot, e.g., having a temperature of 80-100° C., caprolactone is added into the dryer in an amount of 1.1% (by weight) of the polymer. The chips and the blocking agent are thoroughly tumbled for 8 hours to produce a uniform mixture of chips saturated with the blocking agent prior to melt formation. The polyamide chips are melt-spun into fibers, which are characterized by amine end-group concentration of 8-15 meq/Kg, sulfonate-group concentration of 74-76 meq/Kg and carboxyl end group concentration of 75-85 meq/Kg.

Variant 2

An aqueous solution of 2377 g hexamethylene diammonium adipate (AH salt), and aqueous 50% solution of salt of 41.2 kg of 5-sulfoisophthalic acid and equimolar amount of HMD is charged into a stainless steel batch autoclave, under a nitrogen blanket. The autoclave is heated in order to distill the water, at a pressure of 18 Kg/cm.sup.2. As the autoclave temperature reaches 244° C., the pressure is gradually released over a period of 40 minutes until reaching atmospheric pressure. Then the contents of the autoclave are kept for 40 minutes at 274° C. under stirring. The polymer is then discharged from the vessel under nitrogen pressure, and chilled by water. The solid polymer streams ("spaghetti") are chopped into nylon 6,6 chips. The polymer is characterized by a relative viscosity of RV=40-42, amine end-group concentration of 48-52 meq/Kg, carboxyl end-group concentration of 75-85 meq/Kg, sulfonate group concentration of 74-76 meq/Kg and the concentration of the titanium dioxide of 0.3% by weight. Then the polyamide chips are subjected to drying in a tumble-dryer to remove excess moisture. Caprolactone in an amount of 1.6% by weight of the polymer is added along with chips of the polyamide at the feed zone of extruder prior to fiber formation via a feeding pump. The polyamide and caprolactone are then melted together to melt-spun into fibers, which is characterized by amine end-group concentration of 5-15 meq/Kg, carboxyl end-group concentration of 72-78 meq/Kg, and sulfonate group concentration of 74-76 meq/Kg.

Spinning:

The chips of the two polyamides are separately spun in a POY process under the same conditions as in Example 1.

As an example of the results that can be obtained from the invention, FIG. 1 shows a portion of a ladies top in which the body is knitted with a first yarn and a pattern of leaves knitted with a second yarn. In the embodiment shown, the first yarn is high amino polyamide and has a purple color, and the second yarn is low amino polyamide and has a light peach color, however different combinations of high and low amino yarns could be used in the same way and the skilled person can choose from a high number of color combinations, depending on fashion and on the decorative results that he intends to achieve.

Figure 2:
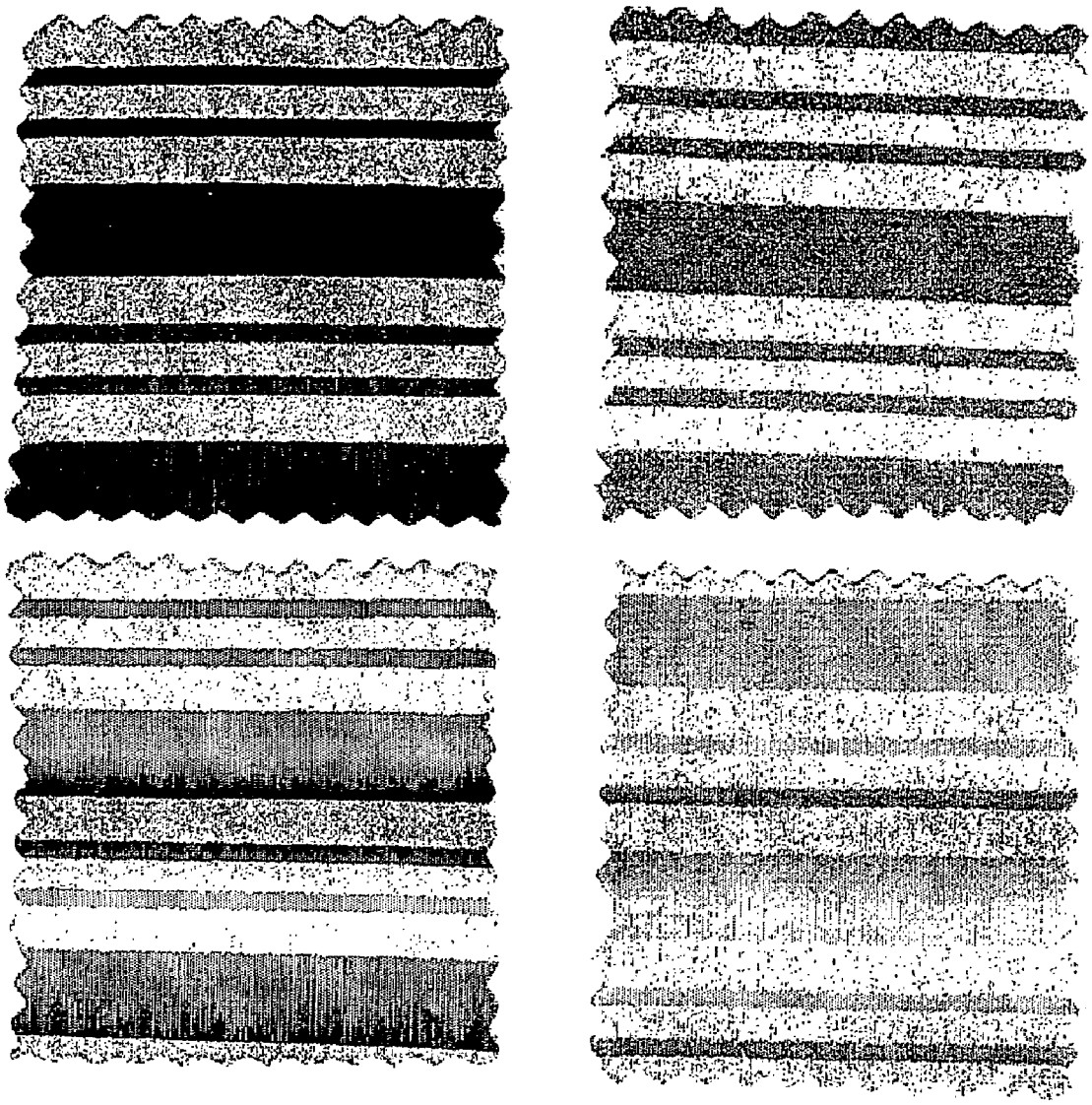
FIG. 2 shows a piece of fabric in which narrow and wide stripes are knitted alternatively with low amino yarn and high amino yarn, dyed in different fashionable colors.

FIG. 2 shows several pieces of fabric in which narrow and wide stripes are knitted alternatively with low amino yarn and high amino yarn and dyed in different fashionable colors. Said pieces are only examples, as the skilled person can choose from a high number of color combinations.

Figure 3:
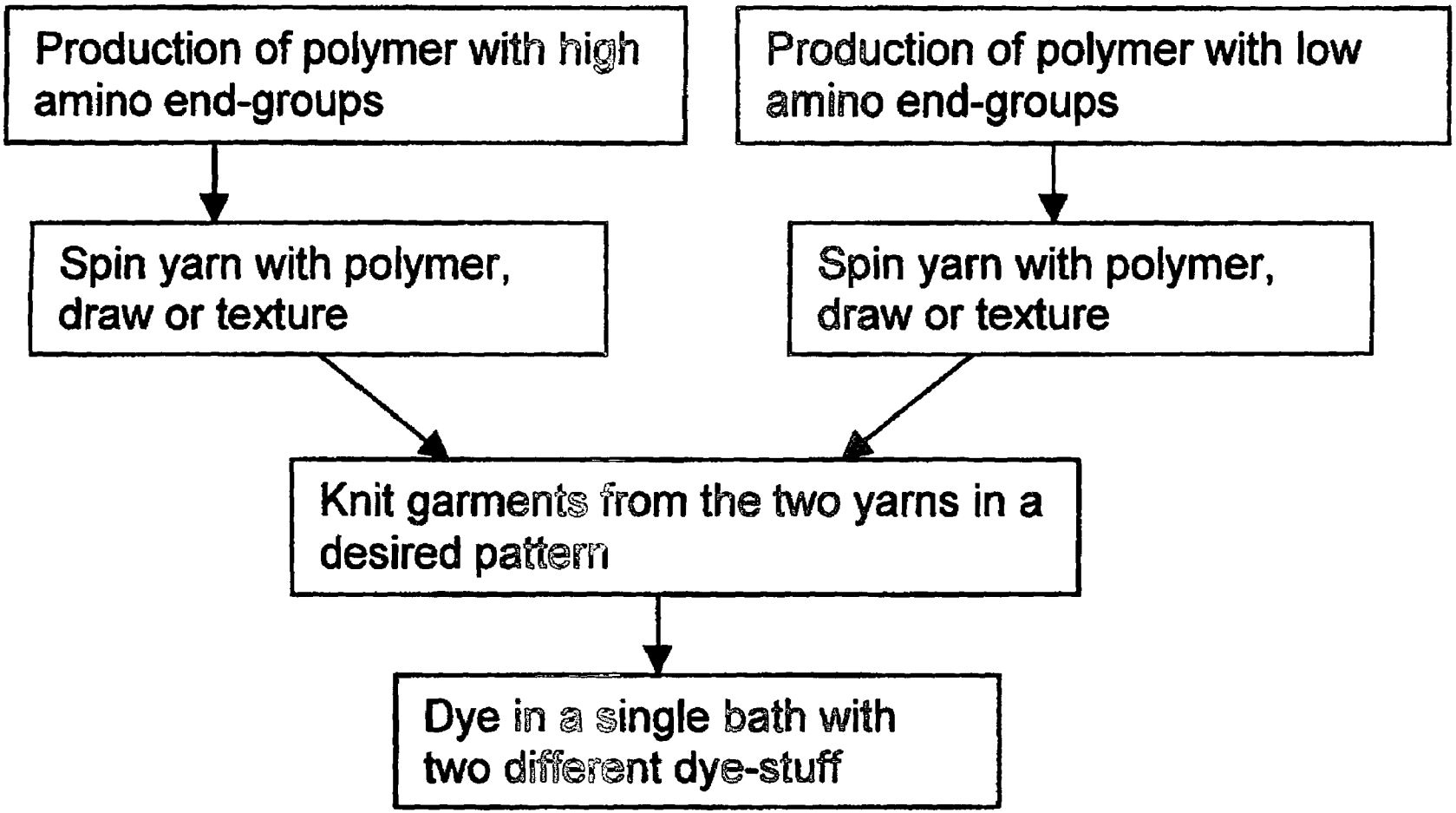
FIG. 3 is a schematic flow chart of an embodiment of the process of the invention for making textile articles bearing designs in different colors.

FIG. 3 is a schematic flow chart of an embodiment of the process of the invention and is self-explanatory in view of the foregoing description. It is seen that garments having patterns in two different colors are obtained by a single dyeing, the single bath comprising two selectively accept the two different colors.

Example 4

Dyeing Method for Dyeing Acid Dyeable and Cationic Dyeable Polyamide (Sensil Cuppelle)

The following is a recommendation for a dyeing procedure for garments made with the yarns of first and second polyamides.

The dyeing method below was used for all the dyeing work carried out. For dyeing conducted using only acid dyes or only basic dyes the exact same methods and auxiliaries were used:

To a dyeing bath at 20° C. were added 0.22 g/l sodium dihydrogen phosphate, 0.5 g/l disodium hydrogen phosphate, 0.1% acetic acid, 1 g/l Intratex NI, 5 g/l of ALBEGAL W (CIBA) and 6 g/l of GLAUBER salt, to give a solution with a pH of 7.0, which is in the optimum pH range in a dyeing process, i.e. 6.5-7.5, a pre-dissolved basic dye and an acid dye dissolved together with 1% Intratex CLW, wherein both dyes are added at pre-determined concentrations. The fabric was immersed in the bath, and the solution was then heated at a rate of 1.5° C./min to a temperature of 98° C. and kept at this temperature for a period of about 60 minutes. The solution was then cooled to a temperature of about 40° C. at approximately the same rate. The bath was then drained from the solution and filled again with water. The fabric was washed twice in clean water at a temperature of about 30° C. and was then passed through soaping, fixing and softening processes which were all standard procedures known in the art.

It was found that the pH level of the solution is very important to produce optimum results. The buffered system gives an extremely stable pH of 7.0 throughout the dyeing cycle, which leads to full exhaustion of the acid dyes and also to very good exhaustion of the basic dyes. Dyeing at pH levels below pH 7.0 results in inferior/poor basic dye exhaustion.

As to the temperature, increased migration and mobility takes place at temperatures above the boil (110° C.), providing better leveling. This can be used if the appropriate machinery is available, or level dyeing problems are encountered.

Selection of Dyes:

Selection of dyes, either for the acid or cationic dyeable component, is based on:

a) Excellent light fastness;

b) Good wet fastness;

c) Excellent reserve of acid/cationic dyeable component;

d) Suitability for dyeing at pH 7;

Recommended dyes and dyes concentrations and combinations are detailed in the lists and table below:

Recommended Dye Selection for Acid Dyeable (Sensil Colorwise) Component:

All dyestuffs are from YORKSHIRE.

| | |
|---|---|
| 1) NEUTRILAN Navy M-BRX | Navy |
| 2) NEUTRILAN Bordeaux M-B | Bordeaux |
| 3) NEUTRILAN Yellow M-3R | Yellow |
| 4) NEUTRILAN Black M-G | Black |
| 5) Nylanthrene Yellow C-4GL | Bright Yellow |

-continued

| | |
|---|---|
| 6) NEUTRILAN Yellow S-2G | Golden Yellow |
| 7) NEUTRILAN Orange S-R | Orange |
| 8) NEUTRILAN Red S-GN | Red |
| 9) Nylanthrene Red C-RA* | Scarlet Red |
| 10) Nylanthrene Red C-B* | Pink Red |
| 11) NEUTRILAN Rubine S-2R | Rubine |
| 12) Inracid Blue F-B | Blue |
| 13) NEUTRILAN Grey S-BG | Grey |
| 14) NEUTRILAN Olive S-G | Olive |
| 15) NEUTRILAN Brown S-2R | Red-Brown |
| 16) Nylanthrene Violet C-B | Violet |
| 17) NEUTRILAN Black S-2B | Black |

*Only use for heavy depths due to light fastness limitations.

The first four dyestuffs are the most recommended acid-metal dyestuffs for the SENSIL COLORWISE.

Recommended dye selection for cationic dyeable (Sensil Pastelle) component; Unless stated otherwise in brackets, all dyes are from YORKSHIRE.

| | |
|---|---|
| 1) Sevron yellow 3RL | Yellow |
| 2) Sevron blue ACN | Blue |
| 3) Sevron red YCN | Red |
| 4) Maxilon yellow GL (CIBA) | Yellow |
| 5) YORACRYL red 2G 200% | Red |
| 6) YORACRYL blue 2 RGL | Blue |

It was found that the first three dyestuffs give better dye fastness and that they are the only dyes that YORKSHIRE recommends for the dyeing of cationic dyeable polyamide.

It is also important to note that when dyeing cationic dyeable polyamide the shade to pale must be kept medium depths. A retarding agent is always recommended for dyeing pale to medium depths, to prevent rapid strike and to achieve level dyeings.

When using Sevron dyes, quick striking of cationic polyamide takes place at a pH range of 6.5-7.5. If level dyeing problems are encountered, lowering the dyebath pH can greatly reduce strike rate. At pH 4.5-5.0 the dyes strike much slower and have better leveling and migration characteristics. Dye exhaustion is, however, very much reduced.

TABLE IV

Recipes recommendations for dyeing:

| | Fabric Colors | % D.S. | Dye-Stuff Colors | Dye-Stuff Colors | Description |
|---|---|---|---|---|---|
| C1 | Lilac | 0.15% | Sevron | Blue | ACN |
| | Black/ | 0.05% | Sevron | Red | YCN |
| | Gray | 0.6% | NEUTRILAN | Black | M-G |
| C2* | Blue/Gray | 0.015% | Sevron | Yellow | 3RL |
| | Black | 0.25% | Sevron | Blue | ACN |
| | | 0.01% | Sevron | Red | YCN |
| | | 0.8% | NEUTRILAN | Black | M-G |
| C4 | Yellow | 0.15% | Sevron | Yellow | 3RL |
| | Bordo | 0.2% | NEUTRILAN | Bordo | M-B |
| C5 | Olive/ | % | Sevron | Yellow | 3RL |
| | Yellow | 0.07% | Sevron | Blue | ACN |
| | Black | 0.8% | NEUTRILAN | Black | M-G |
| C9 | Blue | 0.1% | Sevron | Blue | ACN |
| | Bordo | 0.2% | NEUTRILAN | Bordo | M-B |
| C15 | Blue | 0.35% | Sevron | Blue | ACN |
| | Yellow | 0.02% | Sevron | Yellow | 3RL |
| | | 0.05% | NEUTRILAN | Yellow | M-3R |
| | | 0.005% | NEUTRILAN | Navy | M-BRX |

TABLE IV-continued

| | Fabric Colors | % D.S. | Dye-Stuff Colors | Dye-Stuff Colors | Description |
|---|---|---|---|---|---|
| | | Recipes recommendations for dyeing: | | | |
| C18 | Purple | 0.05% | YORACRYL | Blue | 2RGL |
| | Blue | 0.1% | YORACRYL | Red | 2G 200% |
| | | 0.6% | NEUTRILAN | Navy | M-BRX |

While embodiments of the invention have been described by way of illustration, it will be understood that the invention can be carried out by persons skilled in the art with many modifications, variations and adaptations, without exceeding the scope of the claims.

The invention claimed is:

1. A single-dyeing-step process for manufacturing a fabric having distinctive and sharp differentially colored patterns or designs, which process comprises the steps of:

i) producing a first polyamide having an increased amount of amino end-groups for enhanced anionic dyeing, said first polyamide having a concentration of amine groups in the range of 70-150 meq/kg;

ii) producing a second polyamide, said second polyamide having a concentration of carboxyl end-groups in the range of 60-120 meq/kg, and a concentration of sulfonate groups in the range of 100-150 meq/kg;

iii) reacting said second polyamide with a blocking agent selected from caprolactones and butyrolactones, to reduce the content of amino end-groups of said second polyamide and replace them with hydroxylated groups, and thus simultaneously reduce anionic dyeing and improve cationic dyeing of said second polyamide;

iv) producing a first yarn from said first polyamide and a second yarn from said second polyamide, said second yarn having a concentration of amine groups in the range of 5-18 meq/kg;

v) making a fabric having first surface areas defined by said first yarn and second surface areas defined by said second yarn; and vi) chemically dyeing said fabric in a dyeing bath comprising at least one anionic (acid) dyestuff and at least one cationic (basic) dyestuff, whereby said first yarn and therefore said first surface areas are dyed predominantly by said anionic dyestuff, and said second yarn and therefore said second surface areas are dyed predominantly by said cationic dyestuff;

thereby minimizing cross-staining of said two yarns and achieving said sharp colored patterns or designs.

2. Process according to claim 1, wherein the fabric is a woven or a knitted fabric.

3. Process according to claim 1, wherein the amine groups are primary (end-groups), secondary, and tertiary groups.

4. Process according to claim 1, wherein the amount of the carboxyl end-groups of said first polyamide is in the range of 30-45 meq/kg.

5. Process according to claim 1, wherein the polyamides are selected from the group consisting of Nylon 6,6; Nylon 6,9; and Nylon 6,10.

6. Process of making a textile article having differentially colored patterns or designs, which process comprises manufacturing at least one fabric according to any one of claims 1, 2, 3, 4, and 5 and forming the textile article to arrange said colored patterns or designs to obtain a predetermined ornamental effect.

* * * * *